US006540792B1

(12) United States Patent
Ishii et al.

(10) Patent No.: US 6,540,792 B1
(45) Date of Patent: Apr. 1, 2003

(54) CELLULOSE FIBER-CONTAINING STRUCTURE

(75) Inventors: Masaki Ishii, Shiga (JP); Atsushi Horiuchi, Gifu (JP); Katsuya Okajima, Penang (MY); Akira Nagahara, Osaka (JP); Naoaki Ito, Shiga (JP); Hidenobu Honda, Shiga (JP); Kouichi Saito, Shiga (JP); Yukikazu Nanri, Shiga (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/541,799

(22) Filed: Apr. 3, 2000

(30) Foreign Application Priority Data

Apr. 14, 1999 (JP) ..... 11-106854
Jul. 6, 1999 (JP) ..... 11-191402
Sep. 27, 1999 (JP) ..... 11-271886

(51) Int. Cl.[7] ..... D06Q 1/02

(52) U.S. Cl. ..... 8/115.51; 8/116.1; 427/2.31; 427/389.9; 427/392

(58) Field of Search ..... 8/115.51, 116.1; 427/2.31, 389.9, 392

(56) References Cited

U.S. PATENT DOCUMENTS 4,424,060 A 1/1984 Nakamura et al. ..... 8/115.5
4,996,052 A * 2/1991 McIntosh ..... 424/401
5,499,478 A * 3/1996 Hansen et al. ..... 428/372
5,693,411 A * 12/1997 Hansen et al. ..... 428/238
5,968,599 A 10/1999 Jang et al. ..... 427/393.4
6,039,940 A * 3/2000 Perrault et al. ..... 424/78.06
6,042,877 A * 3/2000 Lyon et al. ..... 427/2.31
6,071,549 A * 6/2000 Hansen et al. ..... 427/2.31
6,197,322 B1 * 2/2001 Dutkiewiez et al. ..... 424/412
6,264,936 B1 * 7/2001 Sawan et al. ..... 424/78.26
6,340,411 B1 * 1/2002 Hansen et al. ..... 162/173

FOREIGN PATENT DOCUMENTS

| | | |
|---|---|---|
| EP | 0 952 248 A2 | 10/1999 |
| GB | 1 024 642 | 3/1966 |
| JP | 2000-080566 | 3/2000 |
| JP | 2000-080571 | 3/2000 |
| WO | WO 98 10648 | 3/1998 |

OTHER PUBLICATIONS

Database WPI Section CH, Week 198705, Derwent Publications, Ltd., London, GB; Dec. 12, 1986; abstract.
Patent Abstracts of Japan; vol. 014, No. 020 (C–676), Jan. 17, 1990; and JP 01 262944 (Nippon Shokubai Kagaku Kogyo Co. Ltd.) Oct. 19, 1989; abstract.

* cited by examiner

*Primary Examiner*—Yogendra N. Gupta
*Assistant Examiner*—D G Hamlin
(74) *Attorney, Agent, or Firm*—Schnader Harrison Segal & Lewis LLP

(57) ABSTRACT

A fiber structure comprising cellulose fibers crosslinked by using a crosslinking agent and synthetic fibers, characterized in that the crosslinking index represented by the following formula of the cellulose fibers is in a range of 1 to 4, and that the synthetic fibers contain an antimicrobial agent having an inorganic value/organic value ratio of 0.3 to 1.4. This structure has antimicrobial property excellent in industrial washing durability and also has shape stability such as crease resistance and shrinkage resistance.

Crosslinking index=$A-B$ where A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%).

22 Claims, No Drawings

CELLULOSE FIBER-CONTAINING STRUCTURE

BACKGROUND OF THE INVENTION

1. Field of the Invention

The present invention relates to a cellulose fibers-containing structure having shape stability and antimicrobial property excellent in industrial washing durability.

2. Description of Related Arts

Antimicrobial fiber structures are widely used in various clothes, interlinings, linings, bedclothes, interior products, etc. Especially in recent years, the intra-hospital infection by Methicillin Resistant Staphylococcus Aureus (MRSA) poses a problem, and as a countermeasure, white overalls, covers, sheets, curtains, etc. are desired to be antibacterial against MRSA.

However, since materials used in this area are frequently industrially washed usually at 60 to 85° C., few conventional techniques can provide those having sufficient durability. Furthermore, if those materials contain cellulose fibers, they have a problem that the shape stability becomes poor after washing.

As conventional antimicrobial treatment, it has mainly been practiced to knead an inorganic antimicrobial agent containing silver, copper or zinc, etc. into synthetic fibers in the stage of spinning as described in Japanese Patent Laid-Open (Kokai) No. Hei9-273073, or to spray or pad an organic antimicrobial agent containing a quaternary ammonium salt, etc. as described in Japanese Patent Laid-Open (Kokai) No. Hei4-11076. The former technique is excellent in view of washing durability, but does not allow fabrics such as woven fabrics and knitted fabrics to be treated. Furthermore, since the antimicrobial agent is precipitated as crystals on the die face in the stage of spinning, there is a problem that yarn breaking occurs often. On the other hand, the latter technique has an advantage that fabrics can be treated to be antimicrobial, but is inferior in view of washing durability of antimicrobial property.

Furthermore, in the applications as described above, fabrics with high cellulose fiber contents are preferably used since they have high water absorbability and are agreeable to the touch, but on the other hand, they have such disadvantages that they are likely to be creased and shrunken by washing compared to synthetic fiber structures and that it is difficult to let them have antimicrobial property durable against industrial washing. These disadvantages are desired to be overcome.

SUMMARY OF THE INVENTION

The object of this invention is to provide a cellulose fibers-containing structure having antimicrobial property excellent in industrial washing durability, and also having shape stability such as crease resistance and shrinkage resistance.

The constitution of this invention is as follows.

A fiber structure comprising cellulose fibers crosslinked by using a crosslinking agent and synthetic fibers, characterized in that the crosslinking index represented by the following formula of the cellulose fibers is in a range of 1 to 4, and that the synthetic fibers contain an antimicrobial agent having an inorganic value/organic value ratio of 0.3 to 1.4.

$$\text{Crosslinking index} = A - B$$

where A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%).

Furthermore, it is preferable that the cellulose fibers are crosslinked and modified by using a specific nitrogen-containing polyfunctional compound, and that the synthetic fibers have a pyridine based antimicrobial agent fixed and exhausted into the fibers.

DESCRIPTION OF THE PREFERRED EMBODIMENTS

The cellulose fibers-containing structure referred to in this invention can be not only a fabric but also a band, string, thread, etc. respectively formed by fibers. It can have any structure and shape, but a fabric, i.e., a woven fabric, knitted fabric or nonwoven fabric respectively containing cellulose fibers is preferable.

The cellulose fibers in this invetnion include natural cellulose fibers such as cotton, hemp and pulp, regenerated cellulose fibers such as viscose rayon, etc.

In this invention, the cellulose fibers are crosslinked and modified by a crosslinking agent. The crosslinking agent refers to a compound which reacts with the hydroxyl groups in the cellulose molecules constituting the cellulose fibers, particularly the hydroxyl groups in an amorphous region causing creasing and shrinkage at the time of washing, for forming a crosslinked structure across and in the cellulose molecules. The crosslinking agents which can be used include formaldehyde, dimethylolethyleneurea, dimethyloltriazine, dimethyloluron, dimethylolglyoxalmonouren, dimethylopropyleneurea, cellulose reactive resins obtained by methoxylating or ethoxylating some or all of the methylol groups of these compounds, polycarboxylic acids, isocyanates, etc. Among these crosslinking agents, for efficiently and effectively crosslinking and modifying cellulose fibers, formaldehyde or a nitrogen-containing polyfunctional compound represented by the following general formula (I) can be preferably used.

(1)

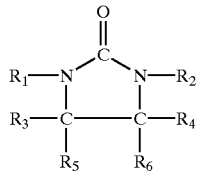

where $R_1$ and $R_2$ denote, respectively independently, —H, alkyl group with 1 to 4 carbon atoms or $CH_2OR_7$; $R_3$, $R_4$, $R_5$ and $R_6$ denote, respectively independently, —H or —$OR_8$; and $R_7$ and $R_8$ denote, respectively independently, —H or alkyl group with 1 to 4 carbon atoms.

As for the modification degree of cellulose fibers, the crosslinking index defined by the following formula must be in a range of 1 to 4. A preferable range is 2 to 3.5. The crosslinking index is calculated by subtracting the value of the coefficient of moisture absorption of the crosslinked and modified cellulose fibers in an atmosphere of 20° C. and 65% RH from the value of the coefficient of absorption in an atmosphere of 30° C. and 90% RH, and it is an index for knowing how far the cellulose fibers are crosslinked and modified. That is, the index uses that the hydroxyl groups in the cellulose molecules are blocked by crosslinking modification to lower the coefficient of moisture absorption. The smaller the index, the larger the degree of crosslinking modification, and the larger the index, the smaller the degree of crosslinking modification. Generally, the crosslinking index of unprocessed cotton and hemp is about 4 to 5.

$$\text{Crosslinking index}=A-B$$

where A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%).

If the crosslinking index is smaller than 1, the crosslinked structure is formed excessively to lower the strength and flexibility of the fabric, and though the fabric is good in shape stability, it cannot be practically used. On the other hand, if the crosslinking index is larger than 4, the crosslinking modification of cellulose fibers is insufficient, and the required level of shape stability such as crease resistance and shrinkage resistance cannot be imparted. Considering the balance among the strength, flexibility and shape stability of the fabric, it is preferable that the crosslinking index is in a range of 2 to 3.5.

The nitrogen-containing polyfunctional compound refers to a compound having nitrogen and two or more functional groups. The compounds which can be used here include, for example, dimethylolethyleneurea, methylated dimethyloluron, dimetlylolpropyleneurea, dimethyloldihydroxyethyleneurea, 4-methoxy-5-dimethylpropyleneurea dimethylolation product, methylated trimethylolmelamine, dimethylolalkyltriazones, dimethylolurea, hexamethylolmelamine, tetramethylolacetylenediurea, etc.

For adding any of these crosslinking agents to cellulose fibers, any of various means can be applied. Particularly, the crosslinking agent can be applied as a gas, or by padding, immersion, spraying, printing, coating, gravure processing or foam processing, etc. When the crosslinking agent is a cellulose reactive resin, polycarboxylic acid or isocyanate, etc., padding can be preferably used.

In the crosslinking modification of cellulose fibers, for the purpose of promoting the reaction of the crosslinking agent, a catalyst can also be preferably used together, and for example, an organic acid, organic amine salt, or a metal salt such as magnesium chloride, zinc nitrate, zinc borofluoride, magnesium nitrate or zinc chloride, etc. can be used.

For crosslinking modification of cellulose fibers by a crosslinking agent, any ordinary crosslinking modification method can be applied. A pre-cure method in which a crosslinking agent is added to a fiber structure formed as a fabric, followed by heat treatment can be used, though this invention is not limited to the method. It is preferable that the heat treatment temperature is 80 to 220° C. A more preferable range is 120 to 200° C.

The cellulose fibers heat-treated like this have the nitrogen-containing polyfunctional compound combined with cellulose molecules, to have antimicrobial property very high in industrial washing durability, and shows a microbicidal activity value (Standard Test Method: JIS L 1902) of larger than 0.

The synthetic fibers which can be used in this invention include polyester fibers of polyethylene terephthalate, polypropylene terephthalate, polybutylene terephthalate, etc., acrylic fibers, polyamide fibers of nylon 6, nylon 66, etc. The fiber structure of this invention can be yarns, woven fabric or nonwoven fabric, etc. Among these synthetic fibers, polyester fibers can provide a fiber structure most excellent in the industrial washing durability of antimicrobial property.

The fiber structure of this invention must have the cellulose fibers and the synthetic fibers mixed as mixed fibers, mix-spun fibers, mixed woven fabric or mixed knitted fabric, etc. In addition, wool, silk, etc. can also be mixed. For securing effective shape stability, it is preferable that the cellulose fibers are contained by 10 to 90 wt % based on the total weight of fibers.

In this invention, the synthetic fibers contain an antimicrobial agent with an inorganic value/organic value ratio of 0.3 to 1.4. A preferable antimicrobial agent is a pyridine based antimicrobial agent having a molecular weight of 200 to 700 and an average particle size of 2 $\mu$m or less.

A pyridine based antimicrobial agent strongly adheres to or is exhausted and diffused into the synthetic fibers. It is considered that if the antimicrobial agent is made closer to a disperse dye to be exhausted and diffused into fibers, in three factors of molecular weight, inorganic value/organic value ratio and average particle size, it shows behavior similar to that of the disperse dye. If these factors are not satisfied, the antimicrobial agent does not strongly adhere or is not exhausted or diffused into the synthetic fibers, and sufficient industrial washing durability cannot be obtained.

If the molecular weight is less than 200, the washing durability tends to be low though the antimicrobial agent adheres to or is exhausted and diffused into the synthetic fibers. On the other hand, if the molecular weight is more than 700, the antimicrobial agent is unlikely to adhere to or to be exhausted into the synthetic fibers. A preferable molecular weight range of the antimicrobial agent is 300 to 500.

The "inorganic value/organic value ratio" in this invention is an indicator contrived by Minoru Fujita, to express the polarity of various organic compounds in view of organic concept [see Revised Edition, Science of Chemical Experiments, Organic Chemistry, Kawade shobo (1971)]. For the ratio, the organic value of one carbon (C) atom is decided as 20, and the inorganic and organic values of various polar groups are decided in reference to it, as shown in Table 1. The inorganic value/organic value ratio refers to the ratio of the sum of inorganic values to the sum of organic values.

TABLE 1

| Inorganic groups | Value | Inorganic groups | Value |
|---|---|---|---|
| Light metal salt | >500 | >CO | 65 |
| Heavy metal salt, amine, ammonium salt | >400 | —COOR, —P=P— | 60 |
| —$AsO_3H$, —$AsO_2H$ | 300 | >C=NH | 50 |
| —$SO_2NHCO$—, —N=N—$NH_2$ | 260 | —N=N— | 30 |
| —$SO_3H$, —CONHCONHCO— | 250 | >O | 20 |
| —$SO_2NH$—, —CONHCONH— | 240 | Benzene nucleus (general aromatic single nucleus) | 15 |
| —CONHCO—, —CSNH— | 230 | Non-aromatic ring | 10 |
| =NOH | 220 | Triple bond | 3 |

TABLE 1-continued

| | | | | |
|---|---|---|---|---|
| =N—NH— | 210 | Double bond | | 2 |
| —CONH— | 200 | Organic and inorganic group | Organic value | Inorganic value |
| —CSSH | 180 | $>SO_2$ | 40 | 110 |
| —CSOH, —COSH | 160 | —SCN | 70 | 80 |
| Anthracene nucleus, phenanthrene nucleus | 155 | —NCS | 70 | 75 |
| —COOH | 150 | $—NO_2$ | 70 | 70 |
| Lactone | 120 | —CN | 40 | 70 |
| —CO—O—CO— | 110 | —NO | 50 | 50 |
| —OH, —As—O—As— | 100 | $—ONO_2$ | 60 | 40 |
| —Hg(organic) | 95 | —NC | 40 | 40 |
| —COSR, —OSOR, —AS=AS— | 90 | —NCO | 30 | 30 |
| Naphthalene nucleus | 85 | —I | 60 | 20 |
| —NH—NH—, —O—CO—O— | 80 | —Br, —SH, —S— | 40 | 20 |
| $—NH_2$, —NHR, $—NR_2$ | 70 | —Cl, —P | 20 | 20 |

Note: In the above inorganic groups, each carbon atom is counted as an organic value of 20. For $SO_2$ group and those enumerated below it, the value is already included in the organic value.

According to this organic concept, for example, the inorganic value/organic value ratio of polyethylene terephthalate can be calculated as 0.7. In this invention, attention is paid to the affinity between synthetic fibers and an antimicrobial agent based on the value calculated according to the organic concept, and an antimicrobial agent with the inorganic value/organic value ratio kept in a predetermined range is caused to adhere to or to be exhausted and diffused into the synthetic fibers.

If the inorganic value/organic value ratio is less than 0.3, the organic property is too strong, and on the contrary if more than 1.4, the inorganic property is too strong. In both the cases, the antimicrobial agent is unlikely to adhere to or to be exhausted and diffused into the synthetic fibers. It is preferable that the inorganic value/organic value ratio is 0.35 to 1.3. A more preferable range is 0.4 to 1.2.

For example, in the case of 2,3,5,6-tetrachloro-4-hydroxypyridine, since it has one benzene nucleus, four —Cl groups, one —OH group and one $—NR_2$ group, the inorganic value is 265. On the other hand, since it has five C (carbon) atoms and four —Cl groups, the organic value is 180. Hence the inorganic value/organic value ratio is 1.47. In the case of 2-pyridylthiol-1-oxide zinc, it exists as a chelate complex, and in view of electronegativity, zinc and sulfur are considered to be covalent-bonded. So, according to the calculation, the compound has an inorganic value of 85 and an organic value of 190, and an inorganic value/organic value ratio of 0.45. On the other hand, in the case of a further other pyridine based antimicrobial agent, 2-pyridylthiol-1-oxide sodium, the difference between sodium and sulfur in electronegativity is more than 1.6, and their bond is an ionic bond. In this case, since sodium acts as a light metal salt, it can be calculated that the inorganic value is 585, that the organic value is 190, and that the inorganic value/organic value ratio is 3.0. So, the compound is poor in affinity to polyesters.

In this invention, among such antimicrobial agents, any one having an average particle size of 2 $\mu$m or less is used. If the average particle size is more than 2 $\mu$m, it is unlikely to adhere to or to be exhausted into the synthetic fibers, and in addition, if it is formed into a treating liquid, the particles settle to show a tendency of poor liquid stability. It is preferable that the average particle size of the antimicrobial agent is 1 $\mu$m or less.

The antimicrobial agents which can be used here include pyridine compounds such as 2-chloro-6-trichloromethylpyridine, 2-chloro-4-trichloromethyl-6-methoxypyridine, 2-chloro-4-trichloromethyl-6-(2-furylmethoxy)pyridine, di(4-chlorophenyl )pyridylmethanol, 2,3,5-trichloro-4-(n-propylsulfonyl)pyridine, 2-pyridylthiol-1-oxide zinc and di(2-pyridylthiol-1-oxide), etc. Among them, especially 2-pyridylthiol-1-oxide zinc is preferable since it is good in affinity to fibers, can adhere to or be exhausted into fibers, hence good in washing durability and effective against a wide range of microbes including MRSA.

Moreover, it is preferable that the fiber structure of this invention has an microbicidal activity value of larger than 0 when measured according to the microbiostatic evaluation method (Standard Test Method: JIS L 1902) established by SEK (Japan Association for the Functional Evaluation of Textiles) still after 50 times of industrial washing treatment at 80° C. for 12 minutes using a wash liquor containing a surfactant. It is most preferable that the microbicidal activity value is larger than 0 when measured according to the microbiostatic evaluation method (Standard Test Method: JIS L 1902) established by SEK (New Function Evaluation Council for Textile Products) still after 50 times of industrial washing treatment at 85° C. for 15 minutes using a wash liquor containing a peroxide, strong alkali and surfactant.

The wash liquor containing a peroxide, strong alkali and surfactant is prepared, for example, by supplying 2 g/l of detergent "Zabu" (registered trademark) produced by Kao Corp. as the surfactant, 3 cc/l of hydrogen peroxide water (35% for industrial use) as the peroxide and 1.5 g/l of sodium percarbonate as the strong alkali, into a drum dyeing machine filled with water at a bath ratio of 1:20. The wash liquor is then heated to 85° C., and the antimicrobial fiber structure of this invention and waste cloth are supplied into it, to be washed for 15 minutes. The waste water is discharged, and the fiber structure is dehydrated and washed with overflowing water for 10 minutes, and dehydrated. This is one time of washing. The washing is repeated 50 times, and the fiber structure is dried using a tumbler dryer for 20 minutes, for microbiostatic evaluation.

For letting the antimicrobial agent adhere to or be exhausted into the synthetic fibers, the fiber structure is immersed in a solution containing the antimicrobial agent in a jet dyeing machine, etc., and heated at atmospheric pressure or under pressurization at 90 to 160° C. for 10 to 120 minutes, preferably at 120 to 135° C. for 20 to 60 minutes. In this case, if necessary, a disperse dye or disperse fluorescent whitening agent can also be added to the solution.

In this method, it is preferable to effect dry heat treatment by a tenter, etc. at 160 to 200° C. for 15 seconds to 5 minutes, more preferably at 170 to 190° C. for 30 seconds to 2 minutes, after completion of the treatment in the solution. This dry heat treatment allows the antimicrobial agent to be diffused into the fibers annularly from the surfaces of the fibers, to allow the washing durability to be improved without impairing the antimicrobial property. These treatment conditions can be changed to control such states as the adhesion of the antimicrobial agent to the surfaces of fibers, the annular distribution in the fibers and the diffusion in the fibers.

As another method, after the solution containing the antimicrobial agent is caused to adhere to the fiber structure by padding or spraying, etc., the fiber structure can be heat-treated by dry heat treatment or wet heat treatment at 160 to 200° C. for 30 seconds to 10 minutes, preferably 170 to 190° C. for 1 to 5 minutes using a tenter, etc.

In view of cost and rationalization of processing, it is preferable that after letting the crosslinking agent and the antimicrobial agent adhere to the fiber structure by padding or spraying, etc., the fiber structure is heat-treated at 170 to 190° C. for 30 seconds to 5 minutes, though the present invention is not limited to this method.

In this invention, for the purpose of improving the softness of the fabric, it is preferable to add a silicone based softening agent. However, if a generally used silicone based softening agent is used, or especially if an amino modified silicone based softening agent mainly composed of an aminoalkyl group-containing polysiloxane is used for treating the fabric, the treated fabric has water repellency though it can have excellent softness and softness durability, and so the treatment is unsuitable for obtaining a cellulose fibers-containing fabric having shape stability such as crease resistance and shrinkage resistance, and also water absorbability as intended in this invention.

Therefore, in this invention, a silicone based softening agent which gives a soft look and taste to the fabric without impairing the water absorbability of the fabric is preferable. Particularly a softening agent mainly consisting of an organopolysiloxane containing both amino groups and polyoxyalkyl groups in one molecule and a polyethylene polyamine higher fatty acid type amide compound containing an amine or at least one group capable of reacting with a hydroxyl group in one molecule is preferable.

The organopolysiloxane is not especially limited as far as it is an organopolysiloxane containing both amino groups and polyoxyalkyl groups in one molecule, i.e., an amino polyether modified silicone. However, an organopolysiloxane having a viscosity of 100 to 100,000 cst at 25° C. and an amino equivalent of 300 to 3000 is preferable. Some or all of the amino groups of the amino polyether modified silicone can be blocked by a compound reactive with the amino groups, an organic acid or the anhydride or chloride, etc. of an organic acid for prevention of yellowing.

The polyethylene polyamine higher fatty acid type amide compound can be, for example, any of reaction products between any of polyethylene polyamine higher fatty acid amides, urea condensation products of polyethylene polyamine higher fatty acid amides and imidazolinium salts of polyethylene polyamine higher fatty acid type amide portions, and any of dicarboxylic acids, cyclic acid anhydrides, diglycidyl ethers, diisocyanates, etc.

The polyethylene polyamines which can be used as a component of these compounds include diethylenetriamine, triethylenetetramine, tetraethylenepentamine, aminoethylethanolamine, etc. The higher fatty acids which can be used here are generally those derived from natural oils and fats such as palm oil, beef tallow, rapeseed oil, rice bran coil and fish oil, but chemically synthesized higher fatty acids can also be used. Among them, higher fatty acids having an iodine value of 50 or less and 12 to 24 carbon atoms are preferable. The dicarboxylic acids and cyclic acid anhydrides include maleic acid, maleic anhydride, fumaric acid, malic acid, succinic acid, succinic anhydride, tartaric acid, phthalic acid, phthalic anhydride, etc. The diglycidyl ethers include ethylene glycol diglycidyl ether, propylene glycol diglycidyl ether, polyoxyalkylene glycol diglycidyl ether, neopentyl glycol diglycidyl ether, 1,6-hexanediol diglycidyl ether, etc. The diisocyanates include aromatic diisocyanates such as tolylene diisocyanate, xylene diisocyanate and diphenylmethane diisocyanate, aliphatic diisocyanates such as tetramethylene diisocyanate, hexamethylene diisocyanate and lysine diisocyanate, etc.

The molar ratio of the polyethylene polyamine and the higher fatty acid constituting the polyethylene polyamine higher fatty acid type amide compound is usually 1:1.0~2.5, preferably 1:1.2~1.8.

The ratio by weight of the aminopolyether modified silicone and the polyethylene polyamine higher fatty acid amide as the main ingredients of the silicone based softening agent is 1:0.2~1.5, preferably 1:0.3~1.0. If the polyethylene polyamine higher fatty acid amide is less than 0.2, sufficient softness cannot be obtained, and if more than 1.5, the treated fabric declines in water absorbability unpreferably.

It is preferable that the deposited amount of the silicone based softening agent is 0.06 to 1.0 wt % based on the weight of the fibers. If the deposited amount is less than 0.06 wt %, it is difficult to impart sufficient softness and smoothness to the fabric, and if more than 1.0 wt %, such defects as texture dislocation are caused though the softness and smoothness are improved.

In this invention, for the purpose of improving the water absorbability of the fabric, it is preferable to add a hydrophilic resin, particularly a hydrophilic polyester resin. As such a resin, a resin mainly composed of a polyalkylene glycol-polyester block copolymer can be preferably used.

The polyalkylene glycol referred to here has a main chain of $—C_nH_{2n}O—$ (n=2~4) in the molecule, and particularly can be polyethylene glycol, polypropylene glycol or a block copolymer thereof, etc. It is preferable that the molecular weight of the polyalkylene glycol is 300 to 4000. A more preferable range is 1000 to 10000. If the molecular weight is less than 300, the durability of deposition in the fibers tends to be insufficient, and if more than 40000, the dispersibility tends to decline.

The polyester which can be used for producing the block copolymer of a polyalkylene glycol consists of an aromatic dicarboxylic acid and an alkylene glycol. The aromatic dicarboxylic acids which can be used here include, for example, terephthalic acid, lower alkyl esters of and terephthalic acid, isophthalic acid and lower alkyl esters of isophthalic acid. The alkylene glycols which can be used here include, for example, ethylene glycol, propylene glycol, butylene glycol, etc.

It is preferable that the deposited amount of the hydrophilic polyester resin is 0.03 to 1.0 wt % based on the weight of the fibers. If the deposited amount is less than 0.03 wt %, the effect of adding the hydrophilic polyester resin is small, and if more than 1.0 wt %, the fabric gives a slimy feeling while the color fastness declines though the water absorbability of the fabric is improved.

In this invention, a vinylsulfonic acid polymer can be preferably fixed to the fiber structure, to make it hygroscopic.

The vinylsufonic acid polymers which can be used in this invention include homopolymers and copolymers of vinylsulfonic acid monomers such as 2-acrylamido-2-methylpropanesulfonic acid, styrenesulfonic acid, isoprenesulfonic acid, allylsulfonic acid and methallylsulfonic acid, and also copolymers consisting of any of these vinylsulfonic acid monomers and a crosslinking agent. As the crosslinking agent of the vinylsulfonic acid polymer, a polyfunctional vinyl monomer which makes the produced polymer three-dimensional can be preferably used. Furthermore, if a vinylsulfonic acid polymer is crosslinked by a crosslinking agent, high washing durability can be obtained.

Moreover, the sulfonate group ends of the vinylsulfonic acid polymer can be substituted by at least one kind of metal ions selected from $Na^+$, $Ni^+$, $Cu^{2+}$, $Zn^{2+}$, $Mn^{2+}$, $Ag^+$ and $Fe^{2+}$, for preventing that the cellulose fibers are made brittle or discolored by an acid. Furthermore, in this invention, it is preferable that the amount of the vinylsulfonic acid polymer to be fixed is 1 to 20% owf in view of hygroscopicity, durability and look & taste, and also in view of excellent hygroscopicity and moisture retention.

In this invention, it is also preferable that the fiber structure is made water-repellent by making a polyfluoroalkyl group-containing acrylic copolymer, silicone resin and aminoplast resin and/or polyfunctional block isocyanato group-containing urethane resin deposited in the fiber structure.

The polyfluoroalkyl group-containing acrylic copolymers which can be used here are not especially limited, and include, for example, homopolymers of vinyl monomers having a polyfluoroalkenyl group with 3 to 20 carbon atoms or a polyfluoroalkyl group, and copolymers consisting of any of such vinyl monomers and another vinyl monomer having neither polyfluoroalkenyl group nor polyfluoroalkyl group.

The vinyl monomers having a polyfluoroalkenyl group or polyfluoroalkyl group which can be used here include, for example, $CH_2{=}CHCOOCH_2C_7F_{15}$ $CH_2{=}C(CH_3)COOCH_2C_6F_{12}CF_3(CF_3)$ $CH_2{=}CHCOO(CH_2)_2N(C_3H_7)SO_2C_8F_{17}$ $C_6F_{13}CH_2OH$ $C_8F_{17}SO_2(C_3H_7)CH_2CH_2OH$ $C_8F_{17}SO_2(C_3H_7)CH_2COOCNH(CH_2)_6NH(CH_2CN_2O)_{11}CH_3$ The other vinyl monomers having neither polyfluoroalkenyl group nor polyfluoroalkyl group include, for example, ethylene, vinyl chloride, vinylidene chloride, acrylamide, styrene, benzyl acrylate, vinyl alkyl ketone, maleic anhydride, isoprene, siloxane and block isocyanates. Among them, an acrylic copolymer mainly composed of a copolymer containing a block isocyanate as a vinyl monomer is suitable. It is preferable that the polyfluoroalkyl group-containing acrylic copolymer is contained by 0.01 to 10% owf based on the amount of the fiber fabric. An especially preferable range is 0.03 to 5% owf.

The aminoplast resins which can be used in this invention include, for example, melamine resins such as trimethylolmelamine resin and hexamethylolmelamine resin, urea resins such as dimethylolpropyleneurea resin, dimethylolethyleneurea resin and dimethylolhydroxyurea resin, uron resins such as dimethyloluron resin. Among them, hexamethylolmelamine resin is suitable. It is preferable that the amount of the aminoplast resin is 0.01 to 2 wt % as the solid content based on the weight of the fiber fabric. An especially preferable range is 0.02 to 1 wt %.

When an aminoplast resin is used, a generally used catalyst can also be used. The catalysts which can be used here include ammonium, aluminum and zinc salts of inorganic acids such as phosphoric acid, sulfuric acid and nitric acid, and salts of organic acids such as formic acid, acetic acid, acrylic acid and succinic acid.

As the polyfunctional block isocyanato group-containing urethane resin in this invention, any organic compound containing two or more block isocyanato functional groups in the molecule can be used without any limitation, and it can be a polyfunctional block isocyanate urethane resin obtained by reaction with aphenol, diethyl malonate, methyl ethyl ketone oxime or sodium bisulfite, etc. to allow reproduction of active isocyanato groups by dissociation when heated.

Especially preferable is a water dispersion of methyl ethyl ketoxime of diphenylmethane diisocyanate or of methyl ethyl ketoxime of trimethylolpropane tolylene diisocyanate adduct.

It is preferable that the amount of the polyfunctional block isocyanate urethane resin is 0.01 to 4 wt % as the solid content based on the weight of the fiber fabric. An especially preferable range is 0.03 to 1 wt %.

Furthermore, a catalyst can also be used to promote the lowering of the dissociation temperature of the polyfunctional block isocyanato group-containing urethane resin, and dibutyltin dioleate, dibutyltin stearate, stearyl zinc or an organic amine compound can be preferably used as the catalyst.

In this invention, a photocatalyst semiconductor composed of a compound oxide of titanium and silicon can be preferably fixed to the fiber structure using at least one binder selected from alkyl silicate resins, silicone resins and fluorine resins, to impart deodorizability and odor impregnation preventability to the fiber structure.

In this invention, the photocatalyst semiconductor has a nature of oxidizing and decomposing organic substances by the strong oxidizing power excited by ultraviolet light, and particularly can be a semiconductor having a crystal structure called anatase, rutile or brookite.

In this invention, attention is paid to the fact that such a photocatalyst semiconductor has deodorizability, coloring matter decomposing and removing capability (antifouling property) and antimicrobial property (antibacterial and antifungal property). Formaldehyde is generated after the cellulose fibers are crosslinked and modified by a crosslinking agent such as formaldehyde or cellulose reactive resin, to impart shape stability such as crease resistance and shrinkage resistance to the cellulose fibers, and also formaldehyde is liberated at the time or crosslinking, to remain in the fabric. The photocatalyst semiconductor is used to oxidize and decomposte such formaldehyde, so that the fabric obtained may be excellent in crease resistance and very small in the concentration of formalin produced to remain as a result of decomposition of the crosslinking agent, preferably as small as 20 ppm or less, and furthermore may have deodorizability, antifouling property and microbicidal capability.

The photocatalyst semiconductor of this invention removes the tobacco smell and the body smell due to sweat, etc. in good balance, which are difficult to remove by conventional techniques. Furthermore, since it can oxidize and decompose such odors, it can prevent the fabric from being impregnated with any odor as an unprecedentedly very excellent effect. Moreover, since it can decompose and remove coloring matters such as the tar of tobacco, it can manifest an antifouling effect against coloring matters. In addition, since the photocatalyst semiconductor of this invention has microbicidal power against MRSA, *Escherichia coli, Staphylococcus aureus,* etc., it can also manifest an effect in antimicrobial and antifungal finishing.

If the photocatalyst semiconductor is too large in particle size or too small in specific surface area, the rate of decomposing organic substances, particularly bacteria tends to decline. As for the deodorizing reaction, offensive odor components are adsorbed by the photocatalyst semiconductor, and later decomposed by the oxidizing power generated by the excitation of the photocatalyst semiconductor caused by ultraviolet light. In this case, whether offensive odor components can be adsorbed well or not greatly affects the deodorizing efficiency. So, a photocatalyst semiconductor with a primary particle size of 20 nm or less and a specific surface area of 100 to 300 $m^2/g$ can be preferably used. If the amount of the photocatalyst semiconductor deposited in the fiber structure is too small, the rate at which organic substances such as offensive odor components are decomposed declines not allowing a sufficient effect to be obtained. If too large on the contrary, the fiber fabric is deteriorated by the oxidation of the photocatalyst semiconductor and becomes hard in taste and look unpractically, and furthermore, the fibers themselves and binder, etc. are decomposed by the oxidative decomposition of the photocatalyst semiconductor , to issue an offensive odor disadvantageously. So, it is preferable that the deposited amount of the photocatalyst semiconductor is 0.05 to 30 wt % based on the weight of the fiber structure. A more preferable range is 0.05 to 20 wt %, and an especially preferable range is 0.08 to 10 wt %.

As the photocatalyst semiconductor of this invention, it is preferable to use a compound oxide of titanium and silicon. As the compound oxide, the compound oxide produced according to the method described in Japanese Patent Publication (Kokoku) No. Hei5-55184 can be used. In general, a binary compound oxide of titanium and silicon is known as a solid acid as described, for example, in "Catalysts" (Vol 17. No. 3, Page 72, 1975), and shows remarkable acidity which cannot be observed in the respective oxides constituting the compound oxide, having a high surface area. That is, the compound oxide of titanium and silicon is not a simple mixture consisting of titanium oxide and silicon oxide, and when a binary oxide of titanium and silicon is formed, it manifests peculiar properties. Furthermore, the compound oxide has an amorphous or almost amorphous fine structure if analyzed by X-ray diffraction, and as for the ratio of titanium and silicon, it is preferable that the compound oxide consists of 20 to 95 mol % of titanium oxide and 5 to 80 mol % of silicon oxide. If the rate of silicone oxide is larger than this range, the photocatalyst activity of titanium oxide tends to be weak. So, it is preferable to decide the optimum ratio for each purpose of use.

In this invention, to make any of various photocatalyst semiconductors such as the compound oxide of titanium and silicon deposited in the cellulose fibers-containing fabric, any of various binders such as urethane resins, acrylic resins and cellulose resins can be used. However, preferably, if at least one binder selected from alkyl silicate resins, silicone resins and fluorine resins is used, the decomposition, coloration and offensive odor generation peculiar to organic resins by the oxidation of the photocatalyst semiconductor can be prevented. In such a combination, it is not necessary to form an intermediate layer of an inorganic substance such as titanium peroxide between the fibers and the binder containing the photocatalyst semiconductor, and the photocatalyst semiconductor can be used to dramatically improve the washing durability, taste & look, and also cost.

An alkyl silicate resin mainly consists of Si—O bond portions and a straight chain or branched chain saturated alkyl group, and has OH groups at both the ends characteristically. That is, it contains a structure represented by the following formula.

$$OH—(Si—O)_n—R—OH$$

In the above formula, R denotes a straight chain or branched chain saturated alkyl group with 1 to 10 carbon atoms, and n is an integer of 1 or more, preferably in a range of 1000 to 10000 for enhancing the inorganic property.

The alkyl group is a straight chain or branched chain saturated alkyl group such as methyl group, ethyl group, propyl group or isopropyl group. The alkyl silicate resin used can also be one alkyl silicate resin or a mixture consisting of two alkyl silicate resins. The alkyl silicate resin has a feature that it easily causes dehydration reaction in the presence of heat, to form a polysiloxane film. The alkyl silicate resin is soluble in water, and if the fiber structure is impregnated with an aqueous solution of the alkyl silicate resin, mangled by a mangle, and treated at 200° C. or lower, a thin film is formed on the surface of each fiber. It is also possible to make the alkyl silicate resin and the compound oxide of titanium and silicon directly deposited on the surface of fiber structure.

A binder mixture consisting of a silicone resin and a fluorine resin can also be deposited on the fiber structure. These binders are, as described above, excellent in heat resistance, light resistance and chemicals resistance, and also excellent in durability against the oxidizing power of the photocatalyst semiconductor.

As the silicone resin, any of condensation crosslinking type resins belonging to silicone resins and silicone varnishes can be used. Products obtained by condensing one or more condensation crosslinking type resins such as tetraethoxysilane and methyltrimethoxysilane can also be used. These resins have a three-dimensional structure and are most excellent in heat resistance and chemicals resistance among silicone resins. If a silicone oxide sol obtained by hydrolyzing tetraisopropoxysilane or tetraethoxysilane by a strong acid in an alcohol/water mixed solvent, a vitreous film can be formed characteristically. The film obtained by such a sol/gel method is close to an inorganic substance and can be preferably used.

Furthermore, as the fluorine resin, a vinyl ether and/or vinyl ester and a polymerizable fluoroolefin compound can be preferably used since they have very excellent properties. For example, polyvinyl fluoride, polyethylene tetrafluoride, tetrafluoroethylene-perfluoroalkyl vinyl ester, vinyl ester-fluoroolefin, etc. can be preferably used since they are less decomposed and deteriorated.

The differences of these silicone resins and fluorine resins from usually often used organic resins such as acrylic resins, urethane resins and epoxy resins are that the former resins contain few hydrocarbon groups likely to be decomposed by heat or chemicals' action, and contain a few hydrocarbon groups such as methyl groups or phenyl groups as the end groups or side chains since the silicone resins are mainly composed of Si—O bonds while the fluorine resins are mainly composed of F—C bonds.

To the binder, a coupling agent can be further added, to improve the bonding strength between inorganic substances and organic substances, thus allowing chemical bond strength to work among the fibers, binder and photocatalyst semiconductor. As a result, the washing durability can be enhanced.

As the binder, zeolite can also be added, to improve the capability to adsorb odor components, and to increase the inorganic component ratio in the structure. As a result, there is an effect of inhibiting the decomposition by the photocatalyst. If zeolite containing a precious metal such as gold, platinum, silver or palladium preferably by 0.01 to 5 wt % is used, the antimicrobial effect can be further enhanced.

In this invention, if the fiber structure is pre-treated by high pressure water vapor and crosslinked and modified using a crosslinking agent, the crease preventing effect higher than the conventional level can be obtained, and the decline of strength after completion of crosslinking modification which has been a conventional problem can be prevented.

The high pressure water vapor referred to here is saturated water vapor of high temperature. Particularly, high pressure saturated water vapor with a temperature of 120 to 200° C. and a pressure of 2 to 16 kg/cm$^2$ is preferable. If the temperature is lower than 120° C., the effect by this treatment is insufficient, and if higher than 200° C., such phenomena as yellowing and embrittlement caused by heat are caused unpreferably. The treatment time can be appropriately set in relation with the treatment temperature. Usually it is preferable that the treatment time is 30 seconds to 30 minutes. For the treatment, any pressure vessel capable of with standing these conditions can be used, and an ordinary autoclave can be used.

The fiber structure is excellent in the antimicrobial property with industrial washing durability, and also in shape stability, and can be preferably used in the form of a woven fabric or knitted fabric, being suitable for such applications as dress shirts, uniforms, inner socks, interior products and sports clothing.

EXAMPLES

The present invention is described below more particularly in reference to examples.

In the following examples and comparative examples, the quality was evaluated according to the following methods.

(1) Washing Method

A drum dyeing machine was used to wash using a wash liquor containing 2 g/l of detergent "Zabu" (registered trademark) produced by Kao Corp., 3 cc/l of hydrogen peroxide water (35% for industrial use) and 1.5 g/l of sodium percarbonate at a bath ratio of 1:20 at 85±2° C. for 15 minutes, and the waste water was discharged. The sample fabric was dehydrated and washed with overflowing water for 10 minutes, then being dried using a tumbler dryer for 20 minutes. This was one time of washing.

(2) Antimicrobial Test Method

The Standard Test Method (JIS L 1902) was adopted, and a clinically isolated MRSA strain was used. A bouillon suspension of said test strain was injected into a sterilized sample fabric and cultured in an enclosed container at 37° C. for 18 hours. The plate counts before and after culture were measured to obtain a plate count increment/decrement as follows.

The log (A/C) at log (B/A)>1.5 was identified as a plate count increment/decrement, hence as an microbicidal activity value. An microbicidal activity value of larger than 0 was judged to be acceptable.

In the above, A denotes the plate count obtained by inoculating a fabric not containing any antimicrobial agent with the strain and immediately recovering the dispersed strain; B denotes the plate count obtained by inoculating a fabric not containing any antimicrobial agent with the strain, culturing it for 18 hours, and recovering the dispersed strain; and C denotes the plate count obtained by inoculating a fabric containing an antimicrobial agent with the strain, culturing for 18 hours and recovering the dispersed strain.

(3) Evaluation of Crease Resistance

Judged based on the 5-stage replica method of AATCC 124-1984. Class 5 (good)~Class 1 (poor)

(4) Washing Shrinkage Percentage

Measured according to JIS L 1042.

(5) Evaluation of Hygroscopicity (ΔMR)

ΔMR (%)=MR2−MR1 where MR1 refers to the hygroscopicity (%) measured after allowing an absolutely dry sample to stand in 20° C. 65% RH atmosphere for 24 hours, which corresponds to an environment in a wardrobe, i.e., an environment before wearing, and MR2 refers to the hygroscopicity (%) measured after allowing an absolutely dry sample to stand in 30° C. 90% RH atmosphere for 24 hours, which almost corresponds to an environment in the clothing involved in any bodily exercise.

ΔMR is obtained by subtracting the value of MR1 from the value of MR2, and suggests how much perspiration in the clothing is absorbed when a person wearing the clothing takes bodily exercise. It can be said that a higher ΔMR value suggests a more comfortable condition. In general, it is said that the ΔMR of polyesters is 0%, that of nylons 2%, that of cotton 4%, and that of wool 6%.

(6) Water Repellency

Evaluated according to JIS L 1092 (spray method).

100: No deposited wetting on the surface.

90: Slight deposited wetting on the surface

80: Wetting at water dropping points on the surface

70: Partial wetting on the entire surface

50: Wetting on the entire surface

0: Full wetting on the surface (7) Odor Impregnation Preventability

Twenty five microliters of 0.01% isovaleric acid aqueous solution was taken by a micro-syringe and 5 μl of it was dropped at 5 points in the central region of a 10 cm×10 cm piece of a fabric; at one point at the center of the fabric and at four points surrounding said one central point, as if to form five spots on a side of a dice. This fabric was allowed to stand under a fluorescent lamp for 3 hours, and smelled by 10 persons for sensory evaluation. The odor in this case was evaluated according to the following criterion, and the mean value was adopted.

5: Severe odor

4: Strong odor

3: Easily sensible odor

2: Discernible but feeble odor

1: Slightly sensible odor

0: No odor

Example 1

A woven fabric (with an areal unit weight of 185 g/m$^2$) was prepared as a sample fabric by mixing polyethylene terephthalate spun fibers and cotton fibers at 50:50 into yarns of 45 yarn number count and using the yarns as warp threads and weft threads.

This woven fabric was immersed in a treating solution of the following composition (1), padded at a squeeze rate of 80%, preliminarily dried at 130° C. for 90 seconds and heat-treated at 180° C. for 1 minute, to prepare a sample. At this moment, the antimicrobial agent had been exhausted and diffused into the fibers. The evaluation results are shown in Table 2.

(1) Composition

Crosslinking agent

Dimethyloldihydroxyethyleneurea resin aqueous solution (solid content 20%)

Catalyst

Magnesium chloride

Antimicrobial agent 2-pyridylthiol-1-oxide zinc (inorganic value/organic value ratio: 0.45, molecular weight: 317, average particle size: 0.5 $\mu$m)

Aminosilicone resin with an amino equivalent of 3000 g/mole (solid content 20%)

Hydrophilic polyester resin

Polyethylene glycol (molecular weight 3000) copolymer emulsion (solid content 10%) consisting of 500 parts of dimethyl terephthalate and 400 parts of ethylene glycol Even after industrial washing, the fabric showed good shape stability and antimicrobial property.

Example 2

A woven fabric obtained by using 75-denier polyethylene terephthalate yarns respectively consisting of 72 filaments and cotton yarns of 45 yarn number count together at 50:50 was used as a sample fabric. The woven fabric was treated as described for Example 1 by a treating solution of the following composition (1), immersed in a treating solution of the following composition (2), mangled by a mangle at a squeezing rate of 40%, dried in a dryer at 120° C. for 2 minutes, treated by a 100° C. heating steamer for 3 minutes and washed with hot water, to obtain a sample. At this moment, the antimicrobial agent had been exhausted and diffused into the fibers. The evaluation results are shown in Table 2.

(2) Composition

| | |
|---|---|
| Sodium 2-acrylamido-2-methylpropanesulfonate | 160 g/l |
| N-methylolacrylamide | 10 g/l |
| Ammonium persulfate | 3 g/l |
| Monomer represented by the following chemical formula where X denotes a methyl group, and n denotes 23. | 30 g/l |

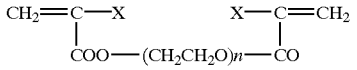

(X = H or $CH_3$, n = integer of 9 to 23)

Even after industrial washing, the fabric showed good shape stability and antimicrobial property, and even after 10 times of household washing, the fabric showed good hygroscopicity.

Example 3

The woven fabric as used in Example 1 was used as a sample fabric and immersed in a treating solution of the following composition (3), padded at a squeezing rate of 80%, preliminarily dried at 130° C. for 90 seconds and heat-treated at 180° C. for 1 minute, to prepare a sample. At this moment, the antimicrobialagent had been exhausted and diffused into the fibers. The evaluation results are shown in Table 2.

(3) Composition

Crosslinking agent

Dimethyloldihydroxyethyleneurea resin aqueous solution (solid content 20%)

Catalyst

Magnesium chloride

Antimicrobial agent 2-chloro-4-trichloromethyl-6-(2-furylmethoxy)pyridine (inorganic value/organic value ratio: 0.73, molecular weight: 329, average particle size: 0.7 $\mu$m)

Silicone resin

Aminosilicone resin with an amino equivalent of 3000 g/mole (solid content 20%)

Hydrophilic polyester resin

Polyethylene glycol (molecular weight 3000) copolymer emulsion (solid content 10%) consisting of 500 parts of dimethyl terephthalate and 400 parts of ethylene glycol Fluorine based water repellent Copolymer (solid content 30%) obtained by copolymerization reaction of the following compounds and distilled water

| | |
|---|---|
| $C_{12}F_{25}(CH_2)_2OCOCH{=}CH_2$ | 88 g |
| $CH_3(C_2H_5)CNONCH(C_6H_4)CH_2(C_6H_4)NHCOO(CH_2)CH{=}CH_2$ | 1 g |
| Stearyl acrylate | 9 g |
| Vinyl chloride | 4 g |
| Stearylmethylammonium chloride | 2 g |
| $C_{12}H_{25}O(C_2H_4O)_{12}H$ | 2.4 g |
| Acetone | 60 g |
| Distilled water | 415 g |
| Amine based catalyst | 0.8 g |

Aminoplast resin

Hexamethylolmelamine resin (solid content 80%)

Catalyst

Organic amine compound

Polyfunctional block isocyanato group-containing urethane resin

Water dispersion (solid content 30%) of methyl ethyl ketoxime of diphenylmethane diisocyanate Catalyst Dibutyltin dioleate Even after industrial washing, the fabric showed good shape stability and antimicrobial property, and even after 10 times of washing, it showed good water repellency.

Example 4

A broad woven fabric with an areal unit weight of 112 g/m$^2$ consisting of 45% of polyester yarns of 45 yarn number count and 55% of cotton yarns respectively scoured and marcerized according to conventional methods was used. The woven fabric was treated as described for Example 1, immersed in a treating solution of the following composition (4) obtained by using an aqueous dispersion of a compound oxide of titanium and silicon (concentration 20%) with an average particle size of 0.3 $\mu$m obtained from a compound oxide of titanium and silicon with an average primary particle size of 7 nm and an average specific surface area of 150 m$^2$/g, as a photocatalyst, padded at a squeezing rate of 80%, preliminarily dried at 130° C. for 90 seconds and heat-treated at 180° C. for 1 minute, to prepare a sample. At this moment, the antimicrobial agent had been exhausted and dispersed into the fibers. The evaluation results are shown in Table 2.

(4) Composition

| | |
|---|---|
| Alkyl silicate resin (concentration 20%) | 1.0 wt % |
| Silicone resin (concentration 45%) | 1.5 wt % |
| Silane coupling agent (concentration 100%) | 0.2 wt % |
| Zeolite carrying a precious metal (concentration 20%) | 0.3 wt % |
| Compound oxide of titanium and silicon (concentration 20%) | 1.0 wt % |

Even after industrial washing, the fabric had good shape stability and antimicrobial property, and also had good deodorizability and odor permeation preventability.

Example 5

Three rolls (each about 25 yards) of the woven fabric used in Example 4 were wound around a 110 cm wide 100 mm dia. bobbin, and treated by high pressure water vapor in an autoclave at 180° C. at a pressure of 9.4 kg/cm$^2$ for 3 minutes. The woven fabric was immersed in a treating solution containing 70 g/l of dimethyloldihydroxyethyleneurea resin aqueous solution (solid content 20%) as a crosslinking agent and 10 g/l of magnesium chloride as a catalyst, padded at a squeezing rate of 80%, preliminarily dried at 100° C. for 2 minutes and heat-treated at 170° C. for 1 minute. At this moment, the antimicrobial agent had been exhausted and diffused into the fibers. The evaluation results are shown in Table 2.

Even after industrial washing, the fabric had good shape stability and antimicrobial property.

Comparative Example 1

A sample fabric as used in Example 1 was treated by a treating solution of the following composition (5), to prepare a sample. The evaluation results are shown in Table 2.

(5) Composition

Antimicrobial agent 2-pyridylthiol-1-oxide zinc

Silicone resin

Aminosilicone resin with an amino equivalent of 3000 g/mole (solid content 20%)

Hydrophilic polyester resin

Polyethylene glycol (molecular weight 3000) copolymer emulsion (solid content 10%) consisting of 500 parts of dimethyl terephthalate and 400 parts of ethylene glycol Comparative Example 2

A sample fabric as used in Example 2 was treated by a treating solution of the following composition (6), to prepare a sample. At this moment, the antimicrobial agent had not been exhausted into the fibers. The evaluation results are shown in Table 2.

(6) Composition

Crosslinking agent

Dimethyloldihydroxyethyleneurea resin aqueous solution (solid content 20%)

Catalyst

Magnesium chloride

Antimicrobial agent

Methyl 6-(2-thiophenecarbonyl)-1H-2-benzimidazolecarbamate (inorganic value/organic value ratio: 1.52, molecular weight: 302, average particle size: 0.5 $\mu$m)

Silicone resin

Aminosilicone resin with an amino equivalent of 3000 g/mole (solid content 20%)

Hydrophilic polyester resin

Polyethylene glycol (molecular weight 3000) copolymer emulsion (solid content 10%) consisting of 500 parts of dimethyl terephthalate and 400 parts of ethylene glycol In Comparative Example 1, since the crosslinking index did not satisfy the condition of claim 1 because of no crosslinking agent used, the shape stability was poor. In Comparative Example 2, since the inorganic value/organic value ratio of the antimicrobial agent did not satisfy the condition of claim 1, the antimicrobial property after washing was poor.

TABLE 2

| | | Example 1 | Example 2 | Example 3 | Example 4 | Example 5 | Comparative Example 1 | Comparative Example 2 |
|---|---|---|---|---|---|---|---|---|
| Crosslinking index | | 3.4 | 3.3 | 3.2 | 3.4 | 3.5 | 4.5 | 2.0 |
| Crease resistance (class) | | 4 | 4 | 4 | 4 | 4-5 | 1-2 | — |
| Washing shrinkage percentage (%) | Warp | 0.2 | 3.0 | 0.2 | 0.2 | 0.2 | 4.0 | 3.4 |
| | Weft | 0.1 | 2.8 | 0.1 | 0.1 | 0.1 | 3.0 | 3.0 |
| Antimicrobial property (microbicidal activity value) | KL-50 | 3.0 | 2.8 | 3.3 | 3.2 | 3.0 | 3.0 | −0.2 |
| Hygroscopicity (ΔMR) | Before washing | — | 4.0 | — | — | — | — | — |
| | After washing | — | 2.5 | — | — | — | — | — |
| Water repellency | Before washing | — | — | 100 | — | — | — | — |
| | After washing | — | — | 70+ | — | — | | — |
| Deodorizability (marks) (isovaleric acid odor) | Before washing | — | — | — | 0.5 | — | — | — |
| | After washing | — | — | — | 1.0 | — | — | — |

What is claimed is:

1. A cellulose fibers-containing structure comprising a) cellulose fibers crosslinked by using a crosslinking agent and b) synthetic fibers, wherein the crosslinking index represented by formula (1) of the cellulose fibers is in a range of 1 to 4, and the synthetic fibers contain c) an antimicrobial agent having an inorganic value/organic value ratio of 0.3 to 1.4, $$\text{Crosslinking index}=A-B \quad (1)$$

where A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%), wherein the antimicrobial agent is at least one pyridine based antimicrobial agent selected from the group consisting of 2-chloro-6-trichloro-methylpyridine, 2-chloro-4-trichloromethyl-6-methoxypyridine, 2-chloro-4-trichloro-methyl-6-(2-furyl-methoxy)pyridine, di(4-chlorophenyl)pyridylmethanol, 2,3,5-trichloro-4-(n-propylsulfonyl)pyridine, 2-pyridylthiol-1-oxide zinc and di(2-pyridylthiol-1-oxide).

2. A cellulose fibers-containing structure, according to claim 1, wherein the molecular weight of the antimicrobial agent is 200 to 700.

3. A cellulose fibers-containing structure, according to claim 1, wherein the average particle size of the antimicrobial agent is 2 $\mu$m or less.

4. A cellulose fibers-containing structure, according to claim 1, wherein the pyridine based antimicrobial agent is 2-pyridylthiol-1-oxide zinc.

5. A cellulose fibers-containing structure, according to claim 1, wherein the antimicrobial agent adheres to or is exhausted into the synthetic fibers.

6. A cellulose fibers-containing structure, according to claim 1, which contains the cellulose fibers by 10 to 90 wt % based on the total weight of the fibers.

7. A cellulose fibers-containing structure, according to claim 1, wherein the crosslinking agent is combined with cellulose and the microbicidal activity value (Standard Test Method: JIS L 1902) of the structure after industrial washing is larger than 0.

8. A cellulose fibers-containing structure, according to claim 1, wherein the synthetic fibers are made of a polyester.

9. A cellulose fibers-containing structure, according to claim 1, which further contains a silicone based softening agent mainly composed of an organopolysiloxane containing both amino groups and polyoxyalkyl groups in one molecule and a polyethylene polyamine higher fatty acid type amide compound containing an amine or at least one group capable of reacting with a hydroxyl group.

10. A cellulose fibers-containing structure, according to claim 9, wherein the polyethylene polyamine higher fatty acid type amide compound is obtained by letting a polyethylene polyamine and a higher fatty acid and at least one selected from lower dicarboxylic acids, cyclic acid anhydrides, lower diglycidyl ethers and diisocyanates react with each other.

11. A cellulose fibers-containing structure, according to claim 9, which contains said silicone based softening agent by 0.06 to 1.0 wt % based on the weight of the fibers.

12. A cellulose fibers-containing structure, according to claim 1, which further contains a hydrophilic polyester resin mainly composed of a polyalkylene glycol-polyester block copolymer.

13. A cellulose fibers-containing structure, according to claim 9, wherein the polyalkylene glycol-polyester block copolymer is contained by 0.03 to 1.0 wt % based on the weight of the fibers.

14. A cellulose fibers-containing structure, according to claim 1, wherein a vinylsulfonic acid polymer is fixed on the surface of the fiber structure by 1 to 20%.

15. A cellulose fibers-containing structure, according to claim 1, wherein the cellulose fibers are pre-treated by high pressure water vapor.

16. A cellulose fibers-containing structure, according to claim 15, wherein the high pressure water vapor is high pressure saturated water vapor of 120 to 200° C.

17. A cellulose fibers-containing structure comprising a) cellulose fibers crosslinked by using a crosslinking agent and b) synthetic fibers, wherein the crosslinking index represented by formula (1) of the cellulose fibers is in a range of 1 to 4, and the synthetic fibers contain c) an antimicrobial agent having an inorganic value/organic value ratio of 0.3 to 1.4, $$\text{Crosslinking index} = A - B \quad (1)$$

where

A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%), wherein the crosslinking agent is a nitrogen-containing polyfunctional compound represented by the following general formula (1):

(1)

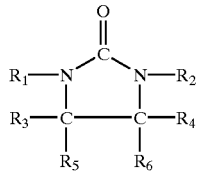

wherein $R_1$ and $R_2$ denote, respectively independently, —H, alkyl group with 1 to 4 carbon atoms or —$CH_2OR_7$, $R_3$, $R_4$, $R_5$ and $R_6$ denote, respectively independently, —H or $OR_8$, and $R_7$ and $R_8$ denote, respectively independently, —H or alkyl group with 1 to 4 carbon atoms.

18. A cellulose fibers-containing structure comprising a) cellulose fibers crosslinked by using a crosslinking agent and b) synthetic fibers, wherein the crosslinking index represented by formula (1) of the cellulose fibers is in a range of 1 to 4, and the synthetic fibers contain c) an antimicrobial agent having an inorganic value/organic value ratio of 0.3 to 1.4, $$\text{Crosslinking index} = A - B \quad (1)$$

where

A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%), wherein a vinylsulfonic acid polymer is fixed on the surface of the fiber structure by 1 to 20%, and wherein the vinylsulfonic acid polymer is obtained from at least one monomer selected from the group consisting of 2-acrylamido-2-methylpropanesulfonic acid, styrenesulfonic acid, isoprenesulfonic acid, allylsulfonic acid and methallylsulfonic acid.

19. A cellulose fibers-containing structure comprising a) cellulose fibers crosslinked by using a crosslinking agent and b) synthetic fibers, wherein the crosslinking index represented by formula (1) of the cellulose fibers is in a range of 1 to 4, and the synthetic fibers contain c) an antimicrobial agent having an inorganic value/organic value ratio of 0.3 to 1.4, $$\text{Crosslinking index} = A - B \quad (1)$$

where

A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%), wherein a polyfluoroalkyl group-containing acrylic copolymer, aminosilicone resin, and aminoplast resin and/or polyfunctional block isocyanate group-containing urethane resin are deposited on the surface of the fiber structure.

20. A cellulose fibers-containing structure comprising a) cellulose fibers crosslinked by using a crosslinking agent and b) synthetic fibers, wherein the crosslinking index represented by formula (1) of the cellulose fibers is in a range of 1 to 4, and the synthetic fibers contain c) an antimicrobial agent having an inorganic value/organic value ratio of 0.3 to 1.4, $$\text{Crosslinking index}=A-B \quad (1)$$

where

A is the coefficient of moisture absorption of the fiber structure after crosslinking in an atmosphere of 30° C. and 90% RH (%), and B is the coefficient of moisture absorption of the fiber structure after crosslinking in an atmosphere of 20° C. and 65% RH (%), and a photocatalyst semiconductor and a binder on the surface.

21. A cellulose fibers-containing structure, according to claim 20, wherein the photocatalyst semiconductor is a compound oxide of titanium and silicon.

22. A cellulose fibers-containing structure, according to claim 20, wherein the binder is at least one binder selected from alkyl silicate resins, silicone resins and fluorine resins.

* * * * *